US007253772B2

(12) United States Patent
Chi et al.

(10) Patent No.: US 7,253,772 B2
(45) Date of Patent: Aug. 7, 2007

(54) WIDE FREQUENCY BAND PLANAR ANTENNA

(75) Inventors: Sheng-Yuan Chi, Taipei County (TW); Shyh-Jong Chung, Hsinchu (TW); Yu-Cheng Chen, Tainan (TW)

(73) Assignee: Delta Networks, Inc., Taipei (TW)

( * ) Notice: Subject to any disclaimer, the term of this patent is extended or adjusted under 35 U.S.C. 154(b) by 104 days.

(21) Appl. No.: 11/164,482

(22) Filed: Nov. 24, 2005

(65) Prior Publication Data

US 2007/0115178 A1 May 24, 2007

(51) Int. Cl.
*H01Q 1/24* (2006.01)

(52) U.S. Cl. ..... 343/700 MS; 343/702

(58) Field of Classification Search ..... 343/700 MS, 343/702, 829, 846, 848
See application file for complete search history.

(56) References Cited

U.S. PATENT DOCUMENTS 4,803,491 A * 2/1989 Hikuma ..... 343/702
4,864,320 A * 9/1989 Munson et al. ..... 343/833
6,536,167 B2 3/2003 Glavan ..... 52/81.3
6,801,168 B1 * 10/2004 Yeh ..... 343/700 MS
6,850,192 B2 * 2/2005 Yeh ..... 343/700 MS

* cited by examiner

*Primary Examiner*—Tho Phan
(74) *Attorney, Agent, or Firm*—Jianq Chyun IP Office

(57) ABSTRACT

A wide frequency band planar antenna comprises an elongated portion, substantially parallel to a circumferential edge of a ground pattern and comprising one end connected to a feeding transmission line, wherein there is a gap between the elongated portion and the circumferential edge of the ground pattern; a body stub and an impedance-matching-adjusting pattern for adjusting an impedance matching between the wide frequency band planar antenna and the feeding transmission line; wherein the gap value is less than 2 mm so as to enable the wide frequency band antenna to operate at a wide range of frequencies ranging from 2.3 GHz to near 6 GHz, thereby allowing the wide frequency band antenna to be applied in both WiFi LAN and WiMAX MAN.

19 Claims, 11 Drawing Sheets

WIDE FREQUENCY BAND PLANAR ANTENNA

BACKGROUND OF THE INVENTION

1. Field of the Invention

The present invention generally relates to a planar antenna, and more particularly, to a wide frequency band planar antenna.

2. Description of Related Art

With the advance of wireless internet access technology, a wireless notebook computer allows users to access the internet at a fixed location where an internet station is located, such as, a train station, a university, etc., within a wireless local area network (WLAN). As a result, the wireless notebook has become a mainstream product because it allows the users to freely access the internet. In recent years, WiFi wireless Local Area Network (LAN) has been introduced, which operates at about 2.4 GHz and 5 GHz (these frequencies are referred as a communication carrier frequency modulated by data signals in any modulation technology, such as an orthogonal frequency division multiplex (OFDM) technology). However, the wireless WiFi LAN technology has some drawbacks that limit the use to only the vicinity of the fixed location. These drawbacks refer to a low capacity and a short range (about several hundred meters) for wireless communication carriers, which prevents the users from accessing the internet at any place. Currently, a wireless WiMAX communication technology (i.e. IEEE 820.16 standard) has been developed to overcome the drawbacks of the wireless WiFi LAN technology; that is, WiMAX allows wireless communication carriers to have a higher capacity and a longer communication range without weakening effect such that the internet can be accessed at any place in a metropolitan area where a WiMAX metropolitan area network (MAN) is hosted. In addition, the wireless WiMAX MAN operates at several frequency bands, which have central frequencies at about 2.3 GHZ, 3.4~3.6 GHz and 5.7~5.8 GHz, respectively. In response to a need for both WiFi LAN and WiMAX MAN applications, a wide frequency band antenna with its operating frequencies ranging from 2.3 GHz to 5.8 GHz, is needed. This wide frequency band antenna is also referred to as an ultra wide frequency band antenna because of its having a ultra wide range of operating frequencies.

Furthermore, a planar antenna is widely employed in the wireless communication technology because it is easily integrated with a printed circuit board (PCB) and thus provides advantages of compactness and low cost. For example, U.S. Pat. No. 6,535,167 B2 disclosed a laminate pattern antenna capable of operating at a wider frequency band. The laminate pattern antenna comprises an inverted-F-shaped antenna pattern formed as a driven element on the obverse-side surface of a PCB, and an inverted-L-shaped antenna pattern formed as a passive element on the reverse-side surface of the PCB. By setting a path length of the inverted-F-shaped antenna pattern to a specific value, this antenna makes the low-frequency side of its usable frequency range shift to the low-frequency side. Likewise, by setting a path length of the inverted-L-shaped antenna pattern to a specific value, this antenna makes the high-frequency side of its usable frequency range shift to the high-frequency side. As a result, the laminate pattern antenna is able to operate at a wider frequency band; however, its operating frequency is about 2.4 GHz, which limits its application only to WiFi LAN, except for WiMAX MAN. Besides, as the laminate pattern antenna has a complicated structure, its fabricating procedures are accordingly lengthy and the procedures for forming the inverted-F-shaped antenna pattern and then the inverted-L-shaped antenna pattern on both side surfaces of the PCB increases a fabricating cost. Accordingly, the laminate pattern antenna fails to meet a compactness requirement of a planar antenna due to its laminated structure, in addition to its narrow frequency band. Hence, the design of a novel pattern planar antenna that has features of multiple frequency bands, a simple antenna structure and a low fabricating cost is desired.

SUMMARY OF THE INVENTION

Accordingly, the present invention is directed to a wide frequency band planar antenna.

The present invention is further directed to a wide frequency band planar antenna with operating frequency ranging from 2.3 GHz to near 6 GHz suitable for both WiFi LAN and WiMAX MAN applications.

Based on the above and other objectives, a wide frequency band planar antenna of the first embodiment of the present invention is provided. The multiple frequency broadband planar antenna comprises an inverted-L-shaped pattern formed by an elongated portion and a body stub. Moreover, the elongated portion is substantially parallel to a circumferential edge of a ground pattern formed on the reverse-side surface of a circuit board (i.e. opposite to the obverse-side surface of the circuit board, on which the wide frequency band planar antenna and other electronic components are mounted), wherein there is a gap G between the elongated portion and the circumferential edge of the ground pattern. In addition, one end of the elongated portion is connected to the body stub with a predetermined length, and another end of the elongated portion is connected to a feeding transmission line so that a high frequency AC current passes through the feeding transmission line into the elongated portion. By adjusting the gap G to a specific value, this planar antenna is able to operate at an ultra wide range of frequencies ranging from 2.3 GHz to about 5.8 GHz (or near 6 GHz) suitable for both WiFi LAN and WiMAX MAN applications.

According to the second embodiment of the present invention, the wide frequency band planar antenna comprises an inverted-L-shaped pattern formed by an elongated portion and a patch pattern that replaces the body stub disclosed in the first embodiment. Moreover, the elongated portion is substantially parallel to a circumferential edge of a ground pattern formed on the reverse-side surface of a circuit board (i.e. opposite to the obverse-side surface of the circuit board, on which the wide frequency band planar antenna and other electronic components are mounted), wherein there is a gap G between the elongated portion and the circumferential edge of the ground pattern. In addition, one end of the elongated portion is connected to the shortest side of the patch pattern that is of rectangular shape with the near-feeding-transmission-line long side tapered outward (the length of the long side is H), and another end of the elongated portion is connected to a feeding transmission line so that a high frequency AC current passes through the feeding transmission line into the elongated portion. By adjusting the gap G to a specific value, this planar antenna is able to operate at an ultra wide range of frequencies ranging from 2.3 GHz to about 5.8 GHz (or near 6 GHz) suitable for both WiFi LAN and WiMAX MAN applications.

According to the first embodiment of the present invention, the multiple frequency broadband planar antenna of the third embodiment of the present invention further comprises an impedance-matching-adjusting stub, one end of which is short-circuited to the ground pattern through a via, and another end is connected to a joint between the elongated portion and the feeding transmission line. Additionally, the short stub serves to adjust an impedance matching between the wide frequency band planar antenna and the feeding transmission line so that a high frequency AC signal passing through the transmission line can be optimally transmitted into the planar antenna with a minimum reflection loss.

According to the second embodiment of the present invention, the wide frequency band planar antenna of the fourth embodiment of the present invention further comprises an impedance-matching-adjusting stub, one end of which is short-circuited to the ground pattern through a via, and another end of which is connected to a joint between the elongated portion and the feeding transmission line. Additionally, the short stub serves to adjust an impedance matching between the wide frequency band planar antenna and the transmission line so that a high frequency AC signal passing through the transmission line can be optimally transmitted into the planar antenna with a minimum reflection loss.

The objectives, other features and advantages of the invention will become more apparent and easily understood from the following detailed description of the invention when taken in conjunction with the accompanying drawings.

DESCRIPTION OF THE EMBODIMENTS

Figure 1A:
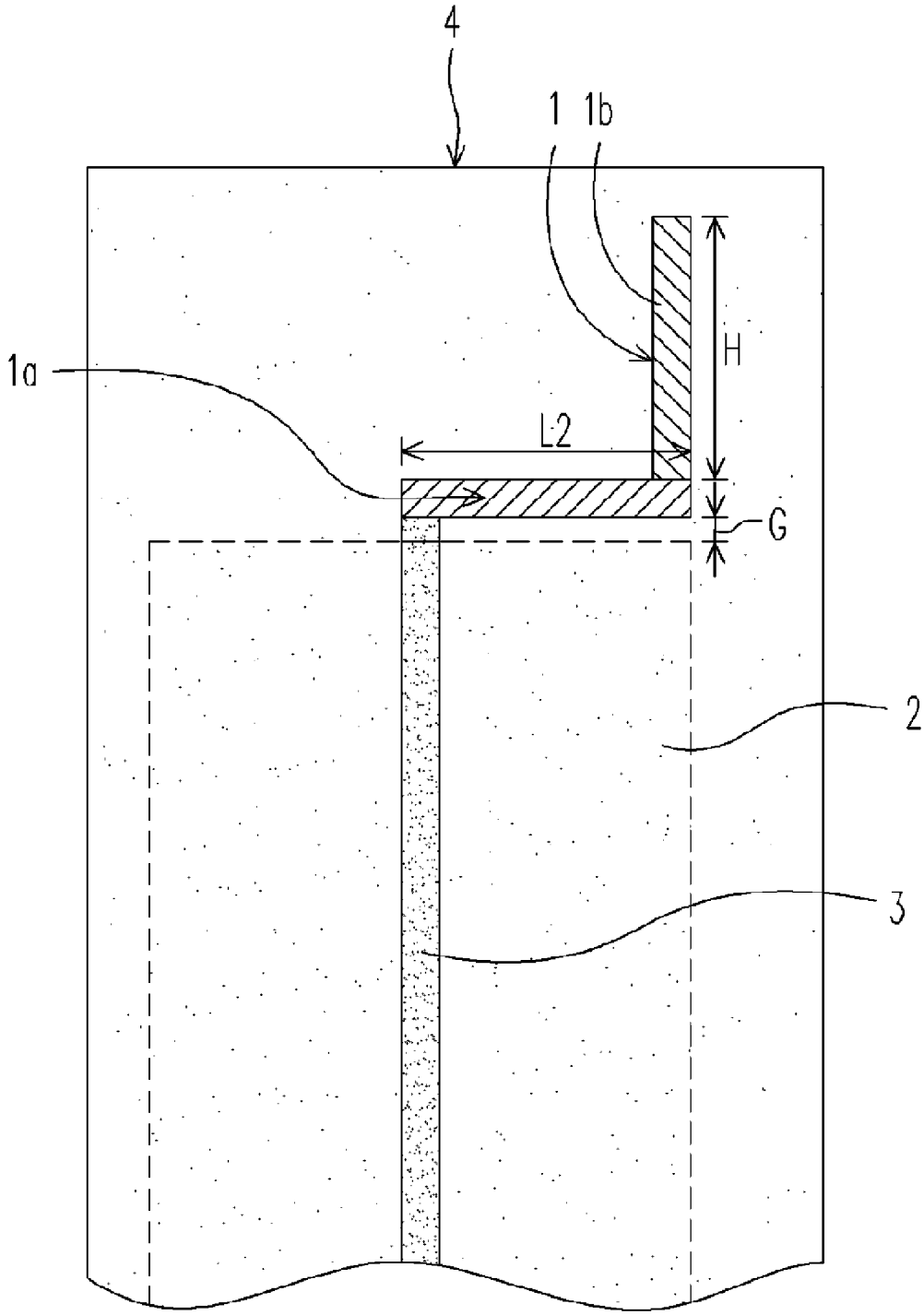
FIGS. 1A and 1B show a top view of a wide frequency band planar antenna of the first embodiment and the second embodiment of the present invention, respectively.

Reference will now be made in detail to a wide frequency band planar antenna, examples of which are illustrated in the accompanying drawings. Wherever possible, the same reference numbers are used in the drawings and the descriptions to refer to the same parts.

FIG. 1A shows a top view of a wide frequency band planar antenna of the first embodiment of the present invention. The wide frequency band planar antenna 1 comprises an elongated portion 1*a* and a body stub 1*b*. Besides, the elongated portion 1*a* and the body stub 1*b* form an inverted-L-shaped pattern, wherein the elongated portion 1*a* is substantially parallel with a circumferential edge of a ground pattern 2 for isolating, which is formed on the reverse-side surface of a circuit board 4 (surrounded by a dash line), opposite to the obverse-side surface (or referred as the component-side surface) thereof, on which the wide frequency band planar antenna and other electronic components are mounted. Moreover, there is a gap G between the elongated portion 1*a* and the edge of circumference of the ground pattern 2. Additionally, one end of the elongated portion 1*a* with a length L2 is connected to one end of the body stub 1*b* with a predetermined length H, while another end of the body stub 1*b* is open, and another end of the elongated portion 1*b* is connected to a feeding transmission line 3 so that a high frequency alterative current (AC) signal passes through the feeding transmission line 3 into the elongated portion 1*a*. Therefore, the high frequency AC signal modulated by data signals with the OFDM technology, is converted to electromagnetic waves with a wide range of frequencies by the wide frequency band planar antenna 1. The electromagnetic waves are in turn used as communication carrier waves with the same frequency as the AC signal.

Currently, the wireless internet-access technology employs several frequency bands with their central frequencies at 2.4 GHz, 3.5 GHz, 5.25 GHz and 5.8 GHz, respectively. Among these frequencies, 2.4 GHz, 5.25 GHz and 5.8 GHz are applied in the WiFi LAN while 2.3 GHz, 3.5 GHz, 5.25 GHz and 5.8 GHz are applied in the WiMAX MAN. The total path length for current passing through the wide frequency band planar antenna 1 is equal to the sum of L2 and H. Preferably, the total path length of the wide frequency band planar antenna 1 is about equal to $\lambda/4$, wherein $\lambda$ is the wavelength of frequency higher than 2.3 GHz. As a result, the wide frequency band planar antenna 1 can be formed as a resonant cavity for a standing wave with a wavelength $\lambda$, and then radiates the electromagnetic wave with the wavelength $\lambda$ for the communication carrier wave. Secondly, and most importantly, the gap G should be small and suitably adjusted so as to obtain a strong electromagnetic coupling between the elongated portion 1*a* and the ground pattern 2. To this end, an additional second harmonic resonant frequency can be produced and pulled down toward the first resonant frequency to form a broad frequency band with a low return loss while operating at frequencies ranging from 2.3 GHz to near 6 GHz.

Figure 1B:
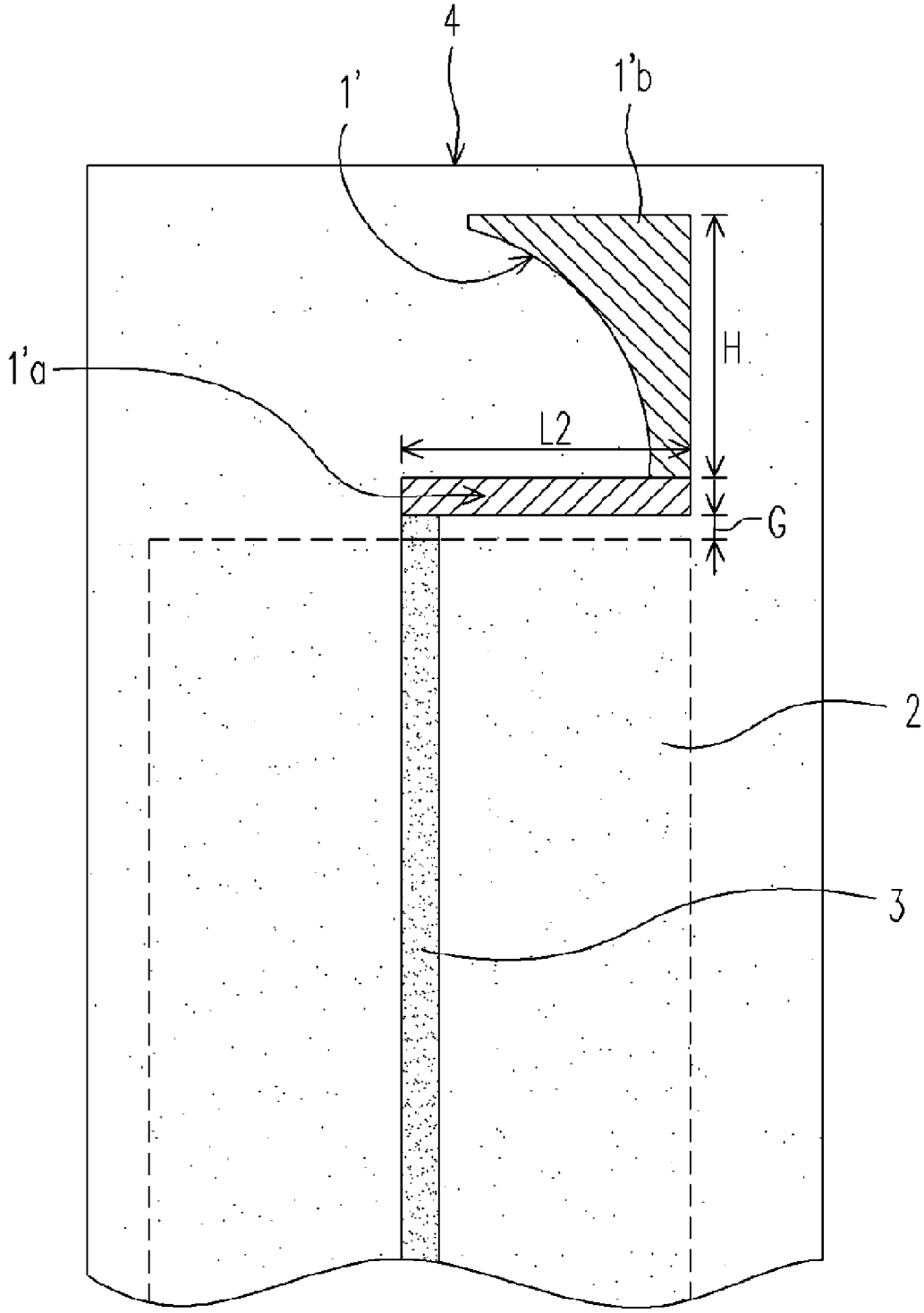

Referring to FIG. 1B, it shows a top view of a wide frequency band planar antenna of the second embodiment of the present invention. The wide frequency band planar antenna 1' comprises an elongated portion 1'*a* and a patch pattern 1'*b* that replaces the body stub 1*b* disclosed in the first embodiment. Besides, the elongated portion 1'*a* with a length L2, is substantially parallel to a circumferential edge of a ground pattern 2 for isolating, which is formed on the reverse-side surface of a circuit board 4(surrounded by a dash line), opposite to the obverse-side surface thereof, on which the wide frequency band planar antenna and other electronic components are mounted. Moreover, there is a gap G between the elongated portion 1'*a* and the circumferential edge of the ground pattern 2. Furthermore, one end of the elongated portion 1'*a* is connected to the shortest side of the patch pattern 1'*b* that is of rectangular shape with the near-feeding-transmission-line long side tapered outward (the length of the long side is H), and another end of the elongated portion 1'*a* is connected to a feeding transmission line 3 so that a high frequency AC signal passes through the feeding transmission line 3 into the elongated portion 1'*a*.

Figure 2A:
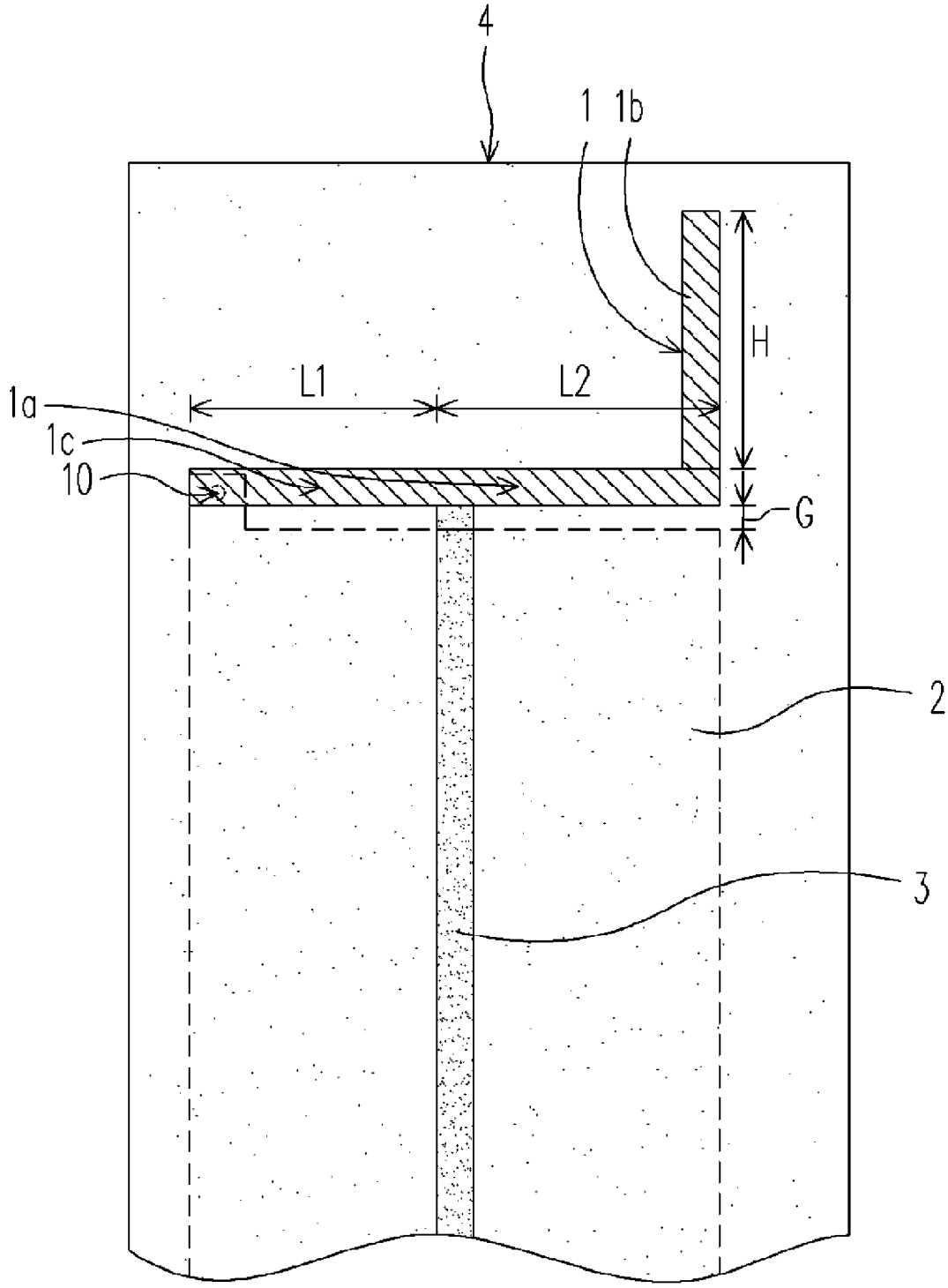
FIGS. 2A and 2B show a top view of a wide frequency band planar antenna of the third embodiment and the fourth embodiment of the present invention, respectively.

Furthermore, as shown in FIG. 2A, according to the first embodiment of the present invention, the wide frequency band planar antenna 1 of the third embodiment of the present invention may further comprise an impedance-matching-adjusting pattern 1*c* with a length L1, such as a short stub, one end of which is short-circuited to the ground pattern 2 formed on the reverse-side surface of the circuit board 4 through a via 10, and another end of which is connected to a joint between the elongated portion 1*a* and the feeding transmission line 3. Additionally, the short stub 1*c* serves to adjust an impedance matching between the wide frequency band planar antenna 1 and the feeding transmission line 3 so that a high frequency AC signal passing through the feeding transmission line 3 can be optimally transmitted into the wide frequency band planar antenna 1 with a minimum reflection loss. How to obtain the preceding optimal impedance matching is described in detail later by referring to FIG. 6.

As mentioned in the first embodiment, the total path length for the current passing through the wide frequency band planar antenna 1 of the third embodiment is equal to the sum of L1, L2 and H, and preferably, the total path length of the wide frequency band planar antenna 1 is about equal to $\lambda/4$, wherein $\lambda$ ranges from a frequency of 2.3 GHz to a frequency of 5.8 GHz (or near 6 GHz), as electromagnetic waves for communication carriers. As a result, the wide frequency band planar antenna 1 can be formed as a resonant cavity for a standing wave with a wavelength $\lambda$, and then radiates the electromagnetic wave with the wavelength $\lambda$ for a communication carrier wave.

Figure 2B:
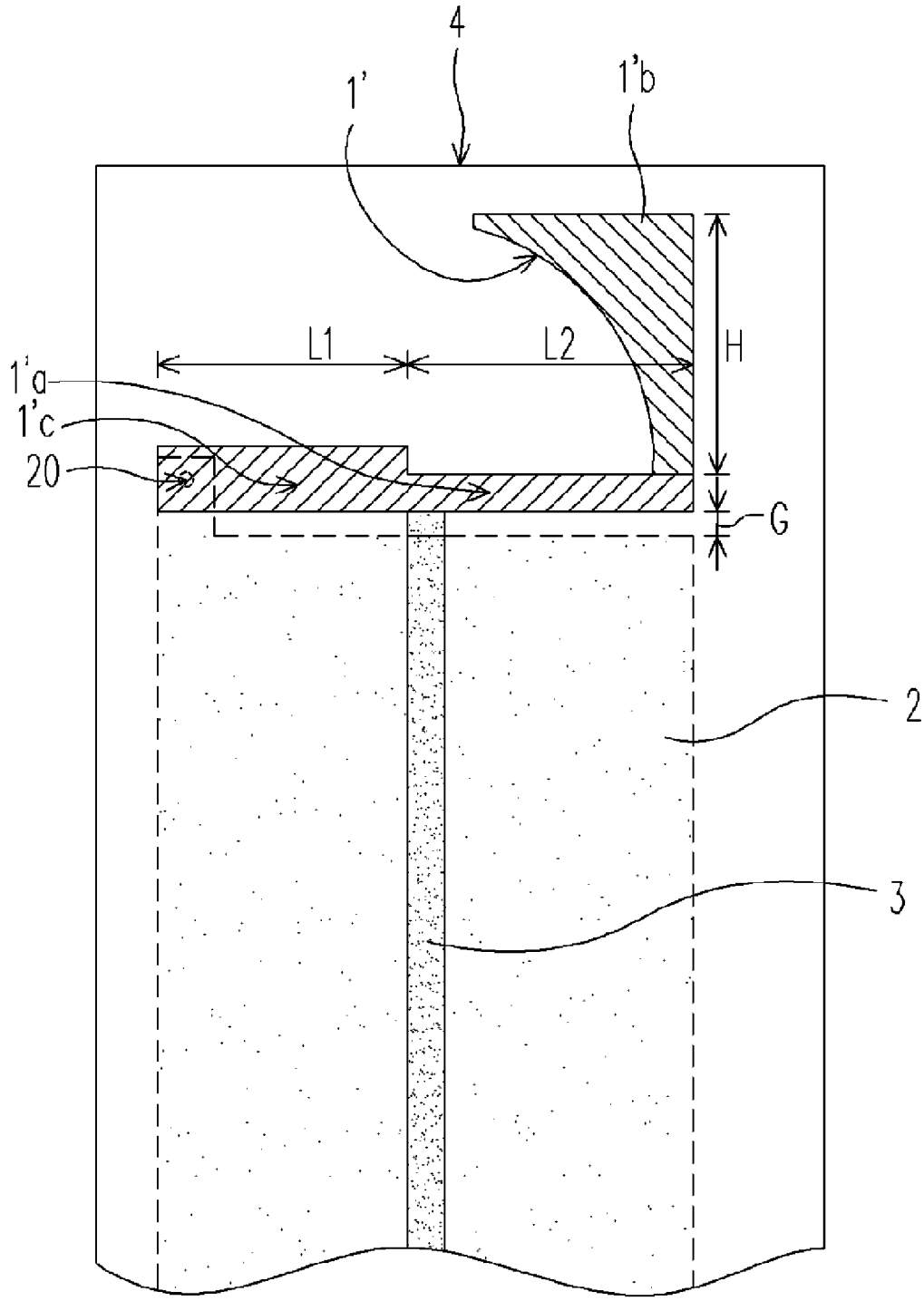

With reference to FIG. 2B, the wide frequency band planar antenna 1' may further comprise an impedance-matching-adjusted pattern 1'*c* with a length L1, such as a short stub, one end of which is short-circuited to the ground pattern 2 through a via 20, and another end of which is connected to a joint between the elongated portion 1'*a* and the feeding transmission line 3. Additionally, the short stub 1'*c* functions to adjust impedance matching between the wide frequency band planar antenna 1' and the transmission line 3 so that a high frequency AC signal passing through the transmission line 3 can be optimally transmitted into the wide frequency band planar antenna 1' with a minimum reflection loss.

Figure 3:
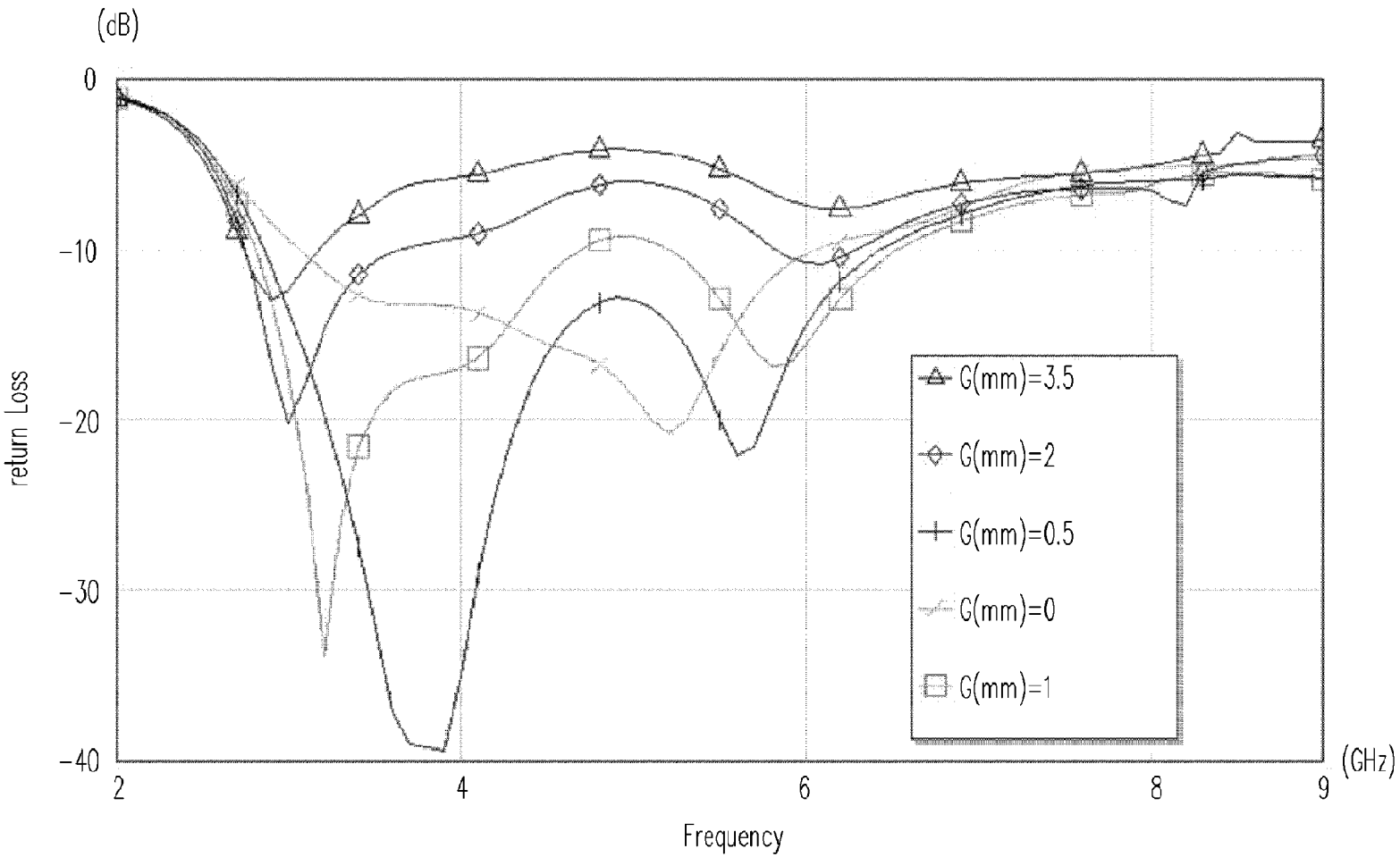
FIG. 3 shows five different return losses vs. frequency graph patterns with a G value ranging from 0 mm to 3.5 mm of the wide frequency band planar antenna shown in FIG. 2A.

When evaluating performance of the wide frequency band planar antenna 1 and 1', their significant characteristics must be taken into account, which includes antenna gain, radiation pattern and how large bandwidth of an available frequency band. When designing a planar antenna with the preceding characteristics, how the values of G, L2 and H affect the characteristics of the wide frequency band planar antenna, should be analyzed, which is described in the following. Prior to the analysis, the definition of "usable-frequency-band" should be introduced. Referring to FIGS. 3, it shows five different return losses vs. frequency graph patterns with a G value ranging from 0 mm to 3.5 mm, and a "usable frequency band" is defined as a frequency band in which all frequencies have their corresponding return losses less than −10 dB, as well as in the "usable frequency band," a frequency range of the highest frequency subtracted from the lowest frequency, is referred to as its "bandwidth." Notwithstanding, in the following, the term of "frequency band" is used to replace the term of "usable frequency band." Besides, the return losses are measured at the junction between the transmission line 3 and the elongated portion 1*a* and 1'*a*, and calculated by the following equation:

$$\text{Return loss}=20\log\lceil \quad (1).$$

Wherein $\lceil$ is a reflection coefficient and equals to a ration of the voltage of the reflected AC signal to that of the incident AC signal at the junction between the transmission line 3 and the elongated portion 1*a* and 1'*a*; that is, the return loss is used to indicate how much the AC signal is attenuated when crossing the junction between the transmission line 3 and the elongated portion 1*a* and 1'*a*. Moreover, according the equation (1), −10 dB return loss means that the original AC signal in the transmission line 3 is attenuated by a factor of ⅓ after crossing the junction between the transmission line 3 and the elongated portion 1*a* and 1'*a*.

FIG. 3 shows five different return losses vs. frequency graph patterns with a G value ranging from 0 mm to 3.5 mm of the wide frequency band planar antenna shown in FIG. 2A. Evidently, from FIG. 3, not only does the number of the "frequency band" is increased, but a bandwidth of each "frequency band" is enlarged as well, as the G value becomes narrower. Eventually, each "frequency band" is overlapped one another so as to form a ultra wide frequency band that ranges from 2.3 GHz to over 6 GHz. Moreover, an increment of the bandwidth is caused by shifting the central frequency of the low frequency band to the high frequency side and shifting that of the high frequency band to the low frequency side. For example, when comparing the G value of 3.5 mm with that of 0.5 mm, it can be seen that there is only one frequency band with a very narrow bandwidth (i.e. about 0.5 GHz bandwidth) when the G value is 3.5 mm, while there are two frequency bands (i.e. the low frequency band and the high frequency band) with their central frequencies at 3.75 GHz and 5.6 GHz, when the G value is 0.5 mm. In the meantime, the two frequency bands are overlapped each other so as to form the ultra wide frequency band that ranges from 2.3 GHz to over 6 GHz. In contrast, when the G value is 1 mm, the low frequency band and the high frequency band are separate and have their central frequencies at 3.6 GHz and 5.95 GHz, respectively. Namely, the bandwidth of the frequency band is widened as the G values become smaller. Accordingly, the smaller G values can meet a requirement of the wide frequency band planar antennas 1 and 1' for operating at a wider range of frequencies. To meet the preceding requirement, the preferable G value is less than 2 mm in the present invention.

Figure 4:
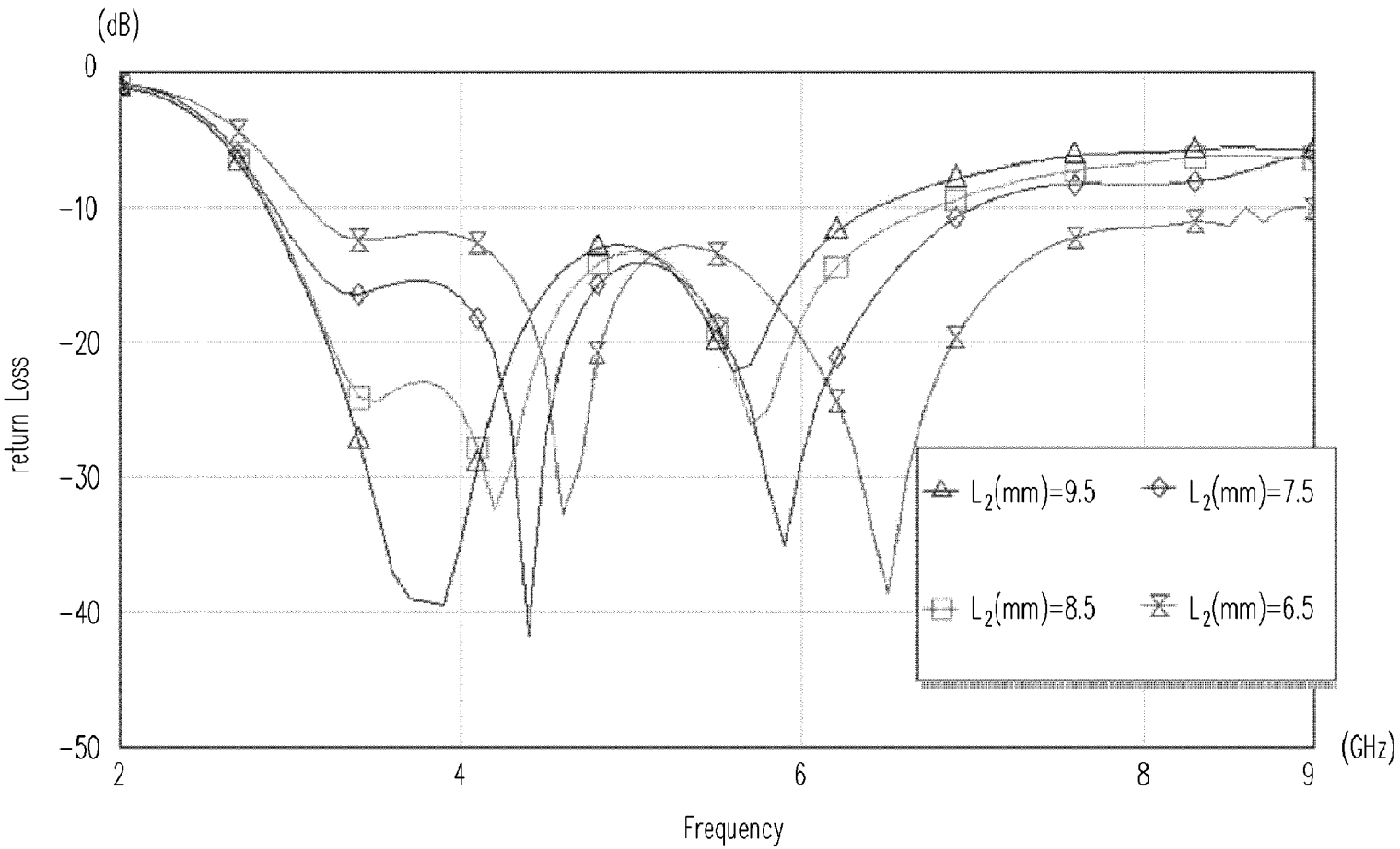
FIG. 4 shows four different return losses vs. frequency graph patterns with a L2 value ranging from 6.5 mm to 9.5 mm of the wide frequency band planar antenna shown in FIG. 2A.

FIG. 4 shows four different return losses vs. frequency graph patterns with a L2 value ranging from 6.5 mm to 9.5 mm of the wide frequency band planar antenna shown in FIG. 2A. Furthermore, the length of the elongated portion, L2, serves to shift the central frequency of frequency bands to the high-frequency side or to the low-frequency side. Referring to FIGS. 4, it shows four different return losses vs. frequency graph patterns with a L2 value ranging from 6.5 mm to 9.5 mm. When comparing the L2 value of 9.5 mm with that of 6.5 mm, it can be seen that as the L2 value becomes smaller, the central frequencies of their frequency bands shift to the high frequency side. In the present invention, the preferable L2 value ranges from 7.5 mm-9.5 mm.

Figure 5:
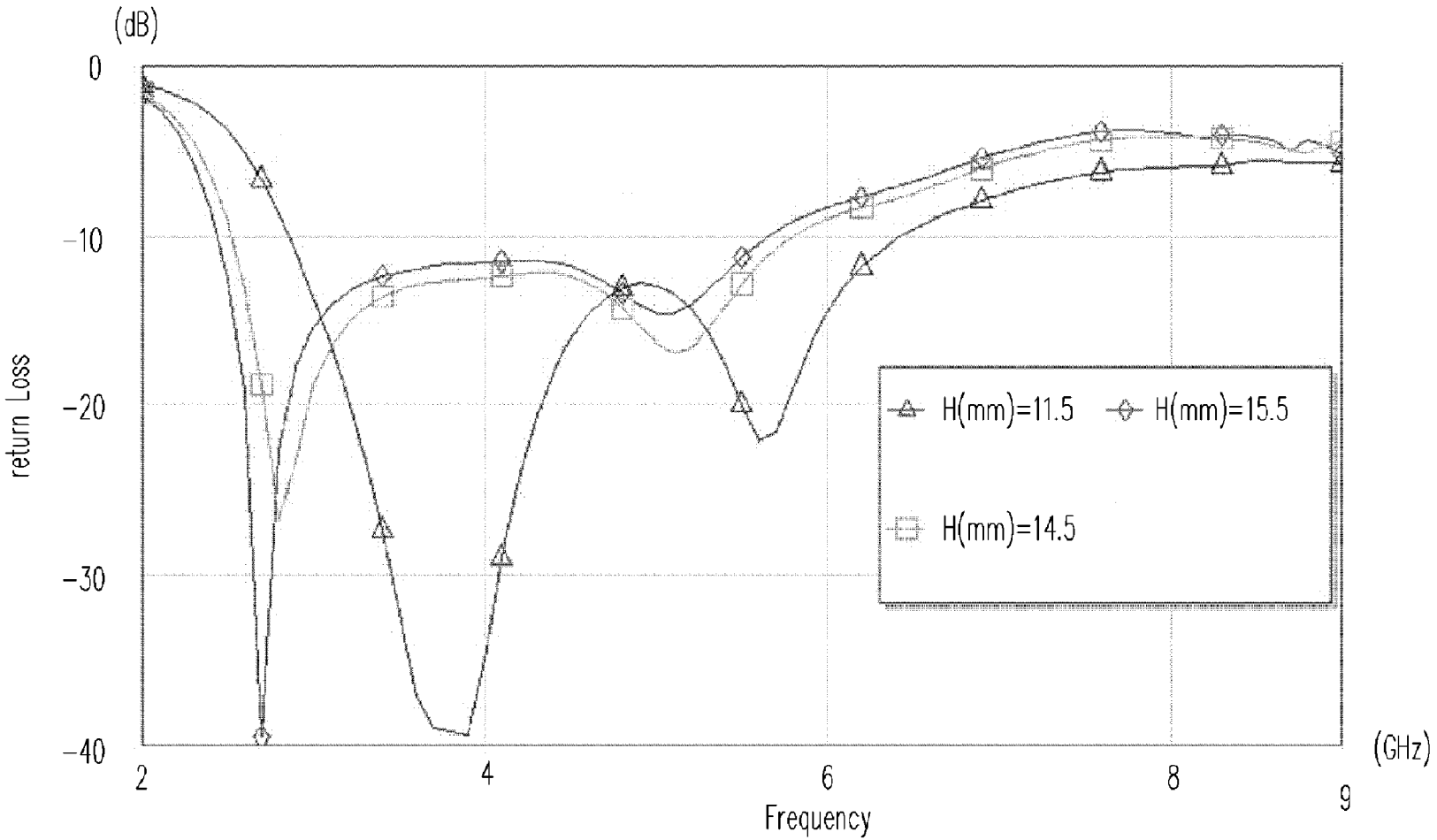
FIG. 5 shows four different return losses vs. frequency graph patterns with an H value ranging from 11.5 mm to 15.5 mm of the wide frequency band planar antenna shown in FIG. 2A.

Additionally, FIG. 5 shows three different return losses vs. frequency graph patterns with a H value ranging from 11.5 mm to 15.5 mm of the wide frequency band planar antenna shown in FIG. 2A. From FIG. 5, comparing the three different return losses vs. frequency graph patterns with a H value ranging from 11.5 mm to 15.5 mm, it can be concluded that the bandwidth of frequency band is kept the same value, but their central frequencies are shifted to the low frequency side as the H value becomes larger. In other words, when the length of the body stub 1*b* becomes longer, the wide frequency band planar antenna 1's operating frequencies are shifted to the low frequency side. In addition, among the G, L2 and H values, the G value mostly affects performance of the wide frequency band planar antenna 1 and 1'. That is, the G value not only initiates "frequency band" but widens bandwidth(s) of the resultant "frequency bands" as well. Eventually, the resultant "frequency bands" is overlapped to form the ultra wide range of frequencies ganging from 2.3 GHz to about 5.8 GHz (or near 6 GHz). Thus, the planar antenna 1 and 1' can be applied in both WiFi LAN and WiMAX MAN.

Figure 6:
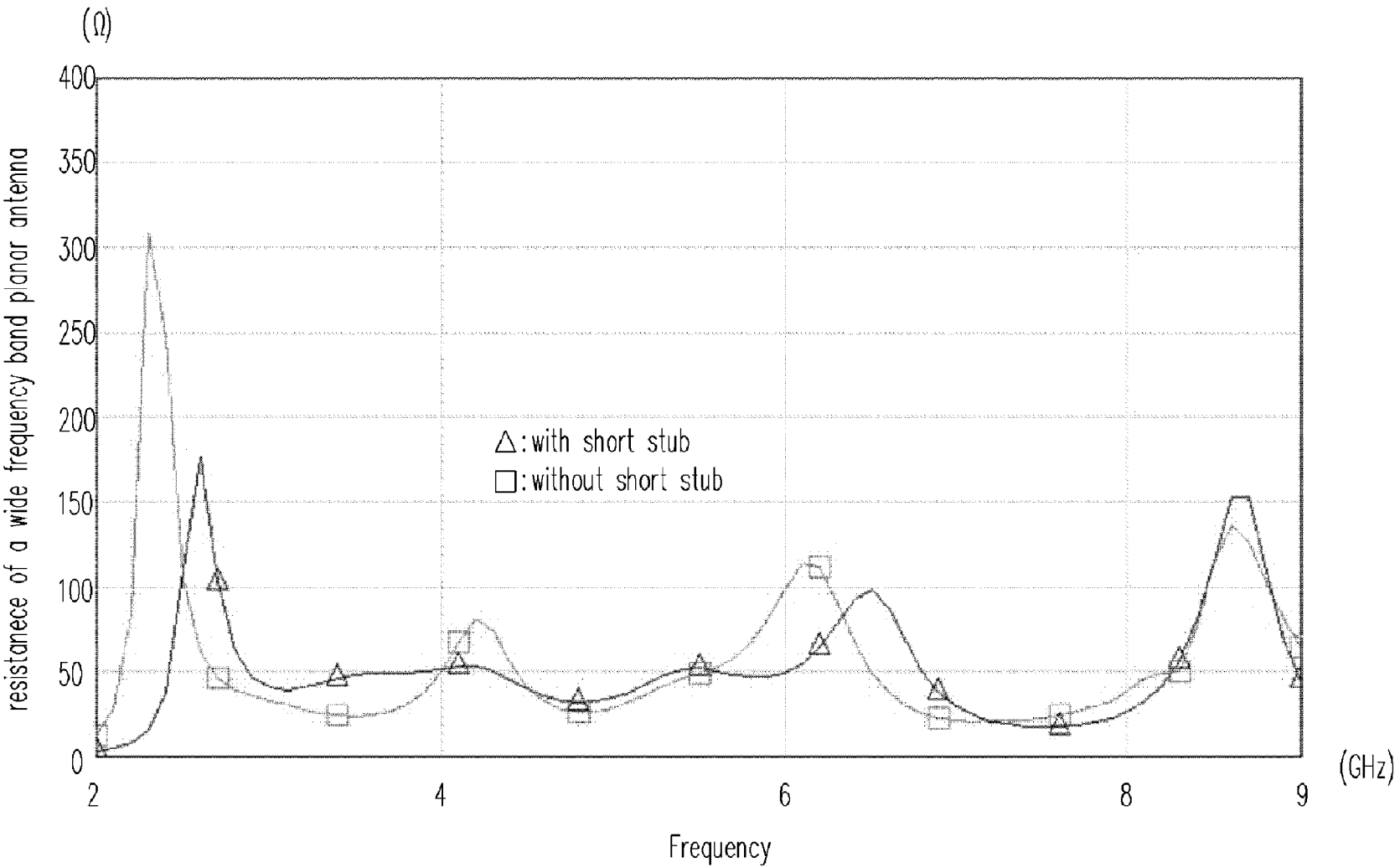
FIG. 6 shows two input resistances of the wide frequency band planar antenna shown in FIG. 2A with and without a short stub vs. frequency graph patterns.

Additionally, the short stub 1*c* and 1'*c* serve to adjust a matching between an impedance of the wide frequency band planar antenna 1 and 1' and that of the transmission line 3 so that a high frequency AC signal passing through the transmission line 3 can be optimally transmitted into the wide frequency band planar antenna 1 and 1' with a minimum reflection loss. Referring to FIG. 6, it shows two resistances of the wide frequency band planar antennas 1 and 1' (i.e. with and without the short stub 1*c* and 1'*c*) vs. frequency graph patterns. Evidently, the resistances of the wide frequency band planar antenna 1 and 1' are stabilized at 50Ω when equipped with the short stub 1*c* and 1'*c*. To achieve a purpose of adjusting a matching between an impedance of the wide frequency band planar antennas 1 and 1' and that of the transmission line 3, the width and length of the short stubs 1*c* and 1'*c* are not necessarily the same as those of the elongated portions 1*a* and 1'*a*. For example, in the third embodiment as shown in FIG. 2A, the width of the short stub 1*c* is the same as the elongated portion 1*a*, whereas, in the fourth embodiment as shown in FIG. 2B, the width of the short stub 1'*c* is larger than that of the elongated portion 1'*a*.

Figure 7A:
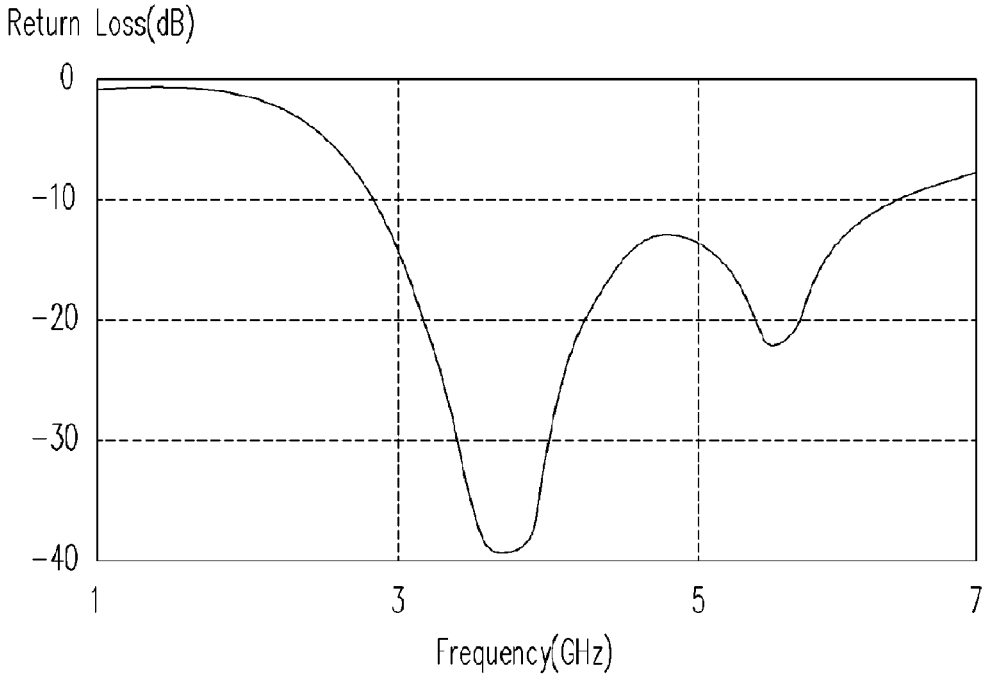
FIG. 7A and FIG. 7B show return loss (unit dB) vs. frequency graphs of the wide frequency band planar antennas of the embodiments shown in FIG. 2A and FIG. 2B, respectively.
Figure 7B:
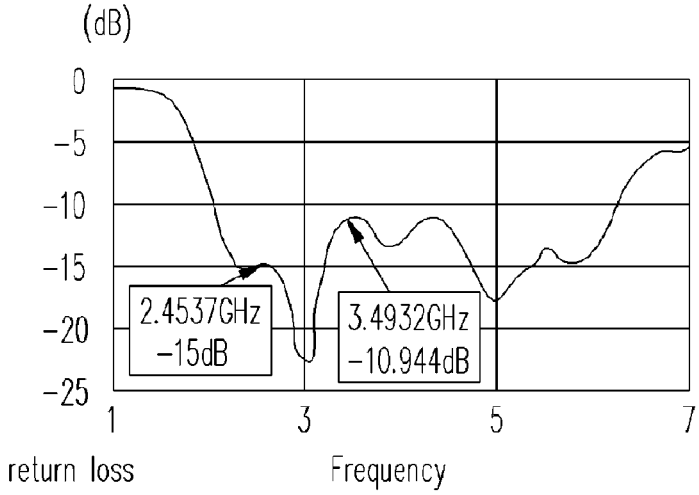
Figure 8A:
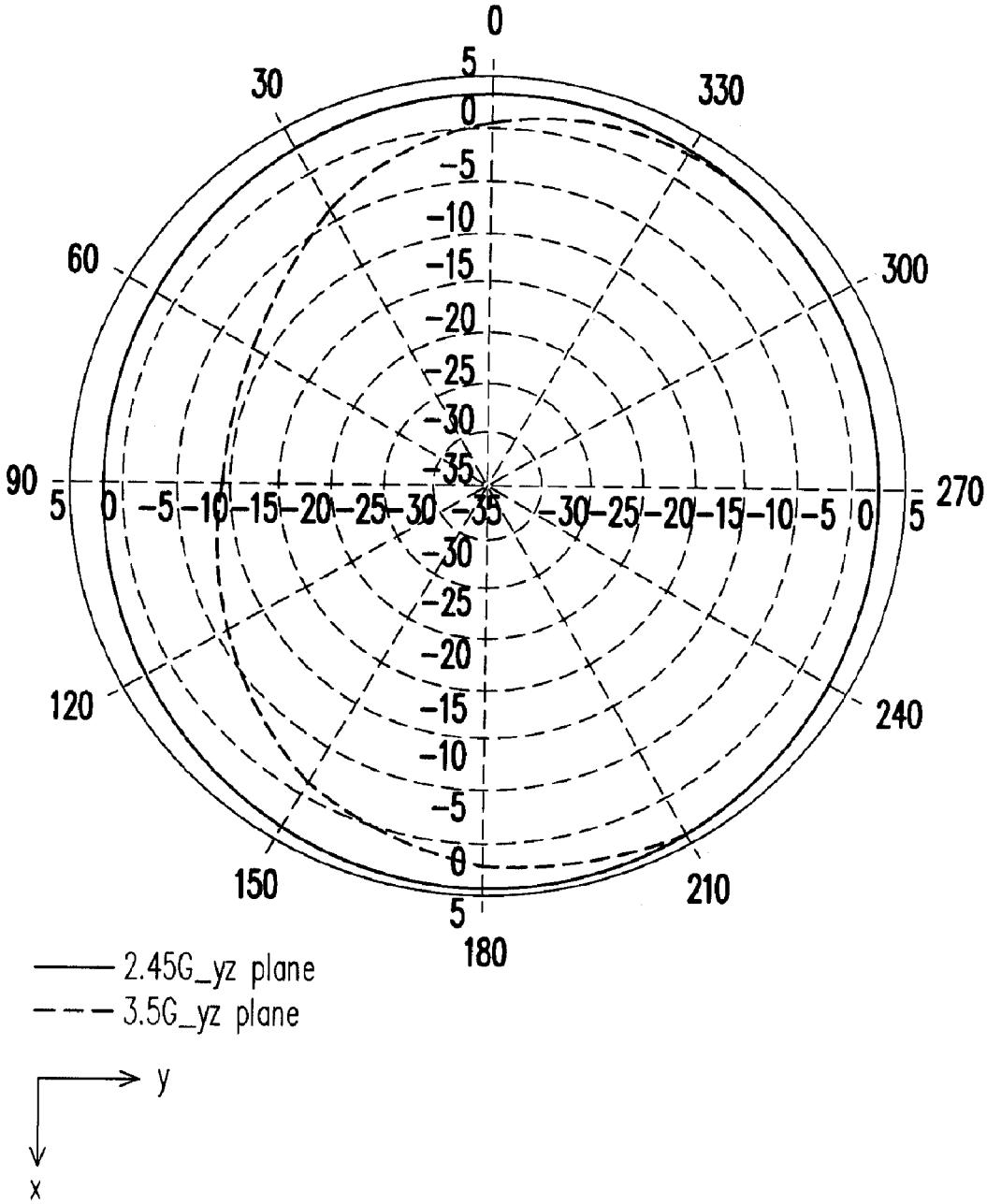
FIGS. 8A and 8B respectively show radiation patterns of the wide frequency band planar antennas of the fourth embodiment shown in FIG. 2B, operating at 2.45 GHz, 3.5 GHz, 5.25 GHz and 5.75 GHz, respectively.
Figure 8B:
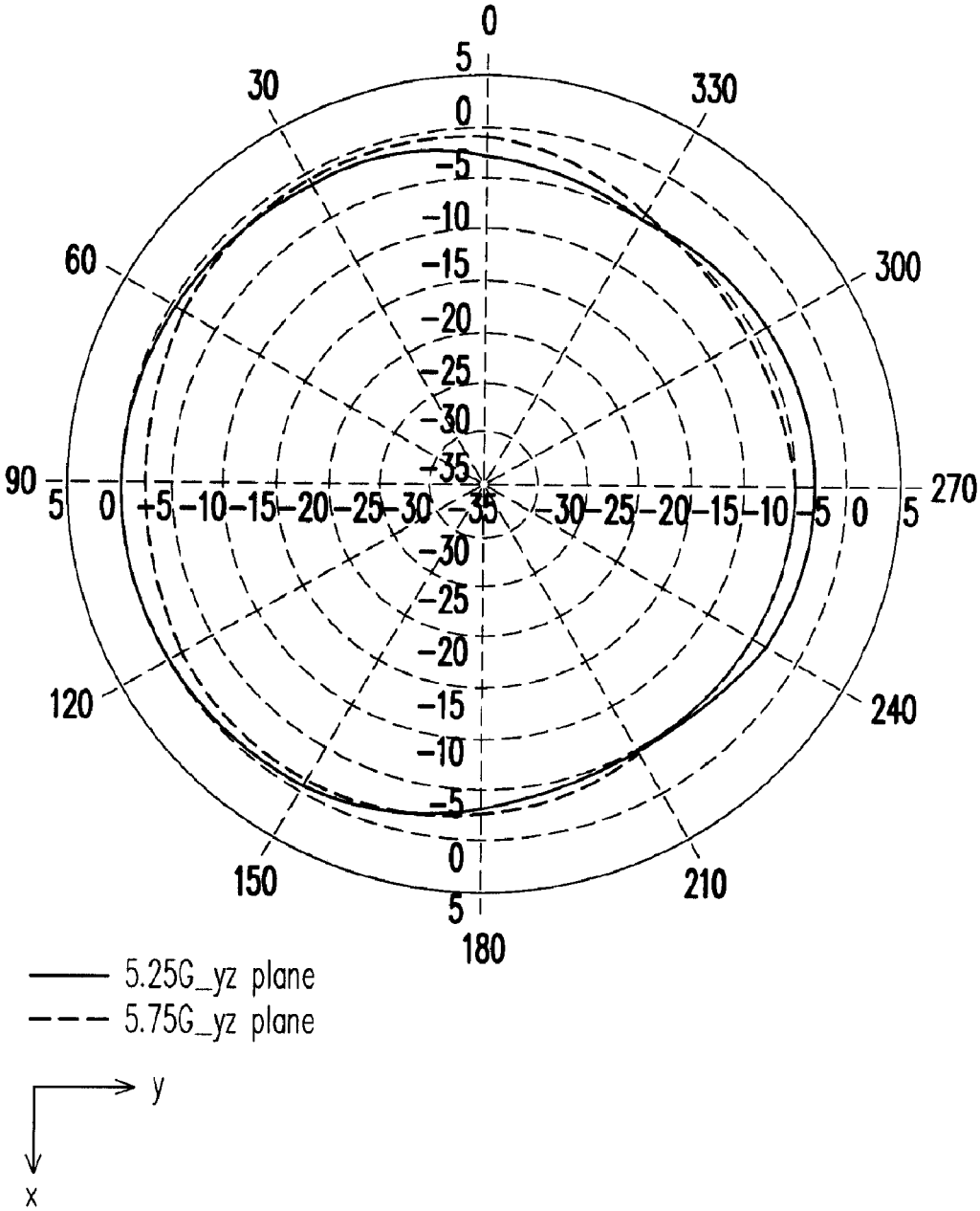

To implement both WiFi LAN and WiMAX MAN simultaneously, the wide frequency band planar antennas of the present invention are able to operate at a wide frequency range. FIG. 7A and FIG. 7B show return loss (unit dB) vs. frequency of the wide frequency band planar antennas of the third and the fourth embodiments of the present invention, as shown in FIG. 2A and FIG. 2B, respectively. Obviously, it is verified that the wide frequency band planar antennas of the third and the fourth embodiments of the present invention are capable of operating at frequency ranging from 2.14 GHz to 6.2 GHz. Furthermore, FIGS. 8A, and 8B show radiation patterns of the wide frequency band planar antenna of the fourth embodiment shown in FIG. 2B of the present invention at 2.45 GHz, 3.5 GHz, 5.25 GHz and 5.75 GHz in y-z plane, respectively. All these radiation patterns are near omni-directional radiation that allows the users to conveniently use a wireless notebook or any wireless communication product that implements the wide frequency band planar antennas 1 and 1' of the present invention.

Additionally, in the preceding four embodiments of the wide frequency band antenna, although they are disposed on the obverse-side surface of the circuit board while the ground pattern is disposed on the reverse-side surface thereof, their disposition can be switched without losing features of the wide frequency band antenna. That is, the wide frequency band antenna can be disposed on the reverse-side surface of the circuit board while the ground pattern is disposed on the obverse-side surface thereof.

In summary, the wide frequency band planar antenna of the present invention has at least the following advantages:

1. The wide frequency band planar antenna of the present invention can be well applied in both WiFi LAN and WiMAX MAN and thus provide the multiple frequency broad-bands with their central frequencies ranging from 2.3 GHz to 5.8 GHz (or near 6 GHz), instead of one frequency band with its 2.4 GHz central frequency of the conventional planar antenna. As a result, the MFB planar antenna of the present invention can be applied in the metropolitan area network so as to allow the wireless notebook users to access the internet at any place in the metropolitan area, rather than being limited to some fixed locations, such as public buildings and train stations, when using the wireless notebook that implements the conventional planar antenna.

2. As the wide frequency band planar antenna of the present invention has a simple structure, its fabricating procedures can be significantly simplified, thereby lowering its fabricating cost and promoting its production yield.

What is claimed is:

1. A wide frequency band planar antenna formed on one-side surface of a circuit board, comprising:

an elongated portion, substantially parallel to a circumferential edge of a ground pattern formed on another-side surface of the circuit board, and comprising one end connected to a feeding transmission line, wherein there is a gap between the elongated portion and the circumferential edge of the ground pattern; and a body stub, comprising an open end and another end connected to another end of the elongated portion to form an inverted-L-shaped pattern; wherein the gap value is less than 2 mm so as to enable the wide frequency band antenna to operate at a wide range of frequencies ranging from 2.3 GHz to near 6 GHz.

2. The wide frequency band planar antenna according to claim 1, wherein the body stub is replaced by a patch pattern that is of rectangular shape with the near-feeding-transmission-line long side tapered outward, and the patch pattern at its shortest side is connected to the elongated portion.

3. The wide frequency band planar antenna according to claim 2, wherein the impedance-matching-adjusting pattern is a short stub.

4. The wide frequency band planar antenna according to claim 2, wherein the length of the elongated portion ranges from 7.5 mm-9.5 mm.

5. The wide frequency band planar antenna according to claim 2, wherein the length of the body stub ranges from 11.5 mm-14.5 mm.

6. The wide frequency band planar antenna according to claim 1, wherein the total path length of the wide frequency band planar antenna is equal to $\lambda/4$, wherein $\lambda$ ranges from the lowest frequency to the highest frequency of the wide range of frequencies.

7. The wide frequency band planar antenna according to claim 1, wherein the length of the elongated portion ranges from 7.5 mm-9.5 mm.

8. The wide frequency band planar antenna according to claim 1, wherein the length of the body stub ranges from 11.5 mm-14.5 mm.

9. A wide frequency band planar antenna formed on one-side surface of a circuit board, comprising:

an elongated portion, substantially parallel to a circumferential edge of a ground pattern formed on the another-side surface of the circuit board, and comprising one end connected to a feeding transmission line, wherein there is a gap between the elongated portion and the circumferential edge of the ground pattern;

a body stub, comprising an open end and another end connected to another end of the elongated portion; and an impedance-matching-adjusting pattern for adjusting an impedance matching between the wide frequency band planar antenna and the feeding transmission line, comprising one end short-circuited to the ground pattern through a via and another end connected to a joint between the elongated portion and the feeding transmission line; wherein the gap value is less than 2 mm so as to enable the wide frequency band antenna to operate at a wide range of frequencies ranging from 2.3 GHz to near 6 GHz.

10. The wide frequency band planar antenna according to claim 9, wherein the body stub is replaced by a patch pattern that is of rectangular shape with the near-feeding-transmission-line long side tapered outward, and the patch pattern at its shortest side is connected to the elongated portion.

11. The wide frequency band planar antenna according to claim 10, wherein the width of the impedance-matching-adjusting pattern is equal or is not equal to that of the elongated portion depending on a need for adjusting the impedance matching between the wide frequency band planar antenna and the feeding transmission line.

12. The wide frequency band planar antenna according to claim 11, wherein the impedance-matching-adjusted pattern is a short stub.

13. The wide frequency band planar antenna according to claim 10, wherein the length of the elongated portion ranges from 7.5 mm-9.5 mm.

14. The wide frequency band planar antenna according to claim 10, wherein the length of the body stub ranges from 11.5 mm-14.5 mm.

15. The wide frequency band planar antenna according to claim 9, wherein the width of the impedance-matching-adjusting pattern is equal or is not equal to that of the elongated portion depending on a need for adjusting the impedance matching between the wide frequency band planar antenna and the feeding transmission line.

16. The wide frequency band planar antenna according to claim 15, wherein the impedance-matching-adjusted pattern is a short stub.

17. The wide frequency band planar antenna according to claim 9, wherein the total path length of the wide frequency band planar antenna is equal to $\lambda/4$, wherein $\lambda$ ranges from the lowest frequency to the highest frequency of the wide range of frequencies.

18. The wide frequency band planar antenna according to claim 9, wherein the length of the elongated portion ranges from 7.5 mm-9.5 mm.

19. The wide frequency band planar antenna according to claim 9, wherein the length of the body stub ranges from 11.5 mm-14.5 mm.

* * * * *